US010260703B2

(12) United States Patent
Shiraishi

(10) Patent No.: US 10,260,703 B2
(45) Date of Patent: Apr. 16, 2019

(54) LIGHTING DEVICE FOR VEHICLE

(71) Applicant: Toshiba Lighting & Technology Corporation, Yokosuka-shi, Kanagawa-ken (JP)

(72) Inventor: Hiromitsu Shiraishi, Yokosuka (JP)

(73) Assignee: Toshiba Lighting & Technology Corporation, Yokosuka-shi, Kanagawa-ken (JP)

( * ) Notice: Subject to any disclaimer, the term of this patent is extended or adjusted under 35 U.S.C. 154(b) by 143 days.

(21) Appl. No.: 14/884,842

(22) Filed: Oct. 16, 2015

(65) Prior Publication Data

US 2016/0153636 A1 Jun. 2, 2016

(30) Foreign Application Priority Data

Nov. 27, 2014 (JP) ..... 2014-239580

(51) Int. Cl.

| | |
|---|---|
| ***F21S 43/19*** | (2018.01) |
| ***F21S 45/47*** | (2018.01) |
| ***F21S 45/48*** | (2018.01) |
| ***F21S 43/14*** | (2018.01) |
| ***F21S 45/00*** | (2018.01) |

(Continued)

(52) U.S. Cl.

CPC ..... *F21S 43/195* (2018.01); *F21S 41/143* (2018.01); *F21S 41/192* (2018.01); *F21S 41/194* (2018.01); *F21S 43/14* (2018.01); *F21S 45/00* (2018.01); *F21S 45/47* (2018.01); *F21S 45/48* (2018.01); *F21S 45/10* (2018.01)

(58) Field of Classification Search

CPC .. F21S 48/1113; F21S 48/1154; F21S 48/212; F21S 48/215; F21S 48/30; F21S 48/328

USPC ..... 362/549

See application file for complete search history.

(56) References Cited

U.S. PATENT DOCUMENTS 5,952,773 A * 9/1999 Manders ..... H01J 5/50 313/318.01
6,409,372 B1 * 6/2002 Peters ..... F21S 48/1109 313/318.01

(Continued)

FOREIGN PATENT DOCUMENTS

DE 102009054620 A1 6/2011
EP 2345836 A2 7/2011

(Continued)

OTHER PUBLICATIONS

Mar. 31, 2016—(EP) Extended Search Report—App 15189672.7.

*Primary Examiner* — Tsion Tumebo
(74) *Attorney, Agent, or Firm* — Banner & Witcoff, Ltd.

(57) ABSTRACT

A lighting device for vehicle according to an embodiment includes a main body unit which has a hole penetrating between a first end portion and a second end portion, and in which at least the vicinity of the hole has electrical conductivity; a light emitting module which is provided in the first end portion of the main body unit, and has a light emitting element; a holding unit which is provided inside the hole of the main body unit, has insulation properties, and an end portion on the second end portion side protrudes compared to a peripheral edge of the hole; and a power feeding terminal of which one end is electrically connected to the light emitting module, has electrical conductivity, and stretches inside the holding unit.

17 Claims, 3 Drawing Sheets

(51) Int. Cl.

| | |
|---|---|
| ***F21S 41/143*** | (2018.01) |
| ***F21S 41/19*** | (2018.01) |
| *F21S 45/10* | (2018.01) |

(56) References Cited

U.S. PATENT DOCUMENTS

| | | | | |
|---|---|---|---|---|
| 7,887,224 | B2 * | 2/2011 | Theelen | H01J 5/56 362/548 |
| 8,358,073 | B2 | 1/2013 | Hayashi et al. | |
| 9,618,188 | B2 * | 4/2017 | Hatanaka | F21S 48/212 |
| 2006/0002125 | A1 * | 1/2006 | Kim | F21K 9/00 362/509 |
| 2007/0145403 | A1 * | 6/2007 | Tomioka | H01L 33/486 257/99 |
| 2011/0074291 | A1 * | 3/2011 | Osawa | F21V 3/00 315/32 |
| 2011/0175529 | A1 | 7/2011 | Hayashi et al. | |
| 2012/0075880 | A1 | 3/2012 | Hayashi et al. | |
| 2015/0016136 | A1 * | 1/2015 | Nakano | F21S 48/212 362/520 |

FOREIGN PATENT DOCUMENTS

| | | | |
|---|---|---|---|
| EP | 2434206 | A2 | 3/2012 |
| JP | H09-298344 | A | 11/1997 |
| JP | 2013-109983 | A | 6/2013 |
| JP | 2014-120446 | A | 6/2014 |
| JP | 2014212073 | A | 11/2014 |
| WO | 2013/076542 | A1 | 5/2013 |
| WO | 2013180178 | A1 | 12/2013 |

* cited by examiner

LIGHTING DEVICE FOR VEHICLE

CROSS-REFERENCE TO RELATED APPLICATIONS

This application is based upon and claims the benefit of priority from Japanese Patent Application No. 2014-239580, filed on Nov. 27, 2014; the entire contents of which are incorporated herein by reference.

FIELD

Embodiments described herein relate generally to a lighting device for vehicle.

BACKGROUND

There is a lighting device for vehicle which includes a main body unit which is formed of a material with high thermal conductivity, a substrate on which a light emitting diode (LED) is provided, and a power feeding terminal which is electrically connected to the light emitting diode.

Here, there is a case in which a material with high thermal conductivity has electrical conductivity. For this reason, there is a case in which the main body unit which is formed of a material with high thermal conductivity has electrical conductivity.

When the main body unit has electrical conductivity, a short circuit occurs when the main body unit and power feeding terminal come into contact with each other.

For this reason, a holding unit which is formed of an insulating material is provided between the main body unit and the power feeding terminal.

Meanwhile, an end portion on a side opposite to the light emitting diode side of the power feeding terminal is exposed from the holding unit so as to be electrically connected to a socket.

For this reason, it is desirable to develop a lighting device for vehicle in which insulation properties between a portion exposed from the holding unit of the power feeding terminal and the main body unit can be improved.

DETAILED DESCRIPTION

Figure 1:
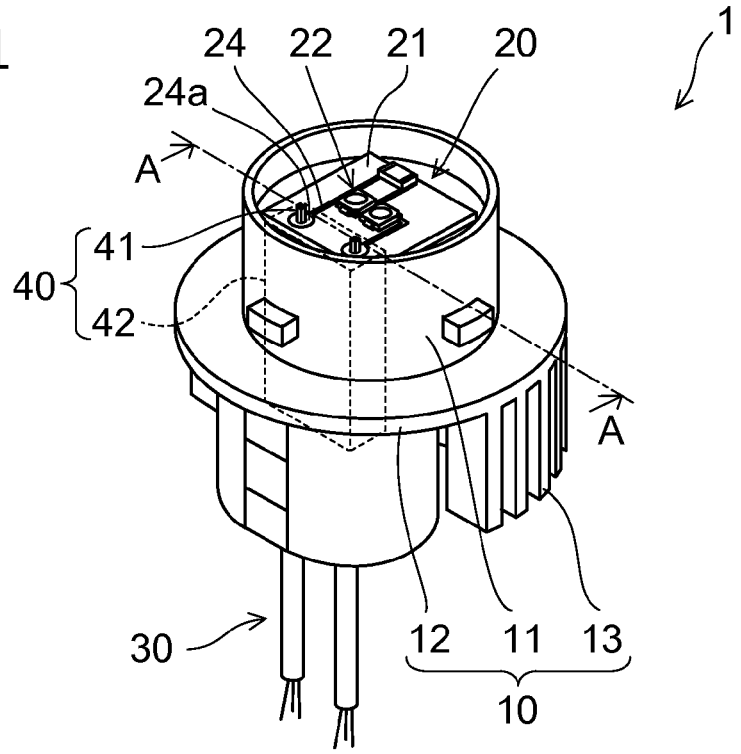
FIG. 1 is a schematic perspective view for illustrating a lighting device for vehicle according to an embodiment.

According to an exemplary embodiment, there is provided a lighting device for vehicle including a main body unit which has a hole penetrating between a first end portion and a second end portion, and in which at least the vicinity of the hole has conductivity; a light emitting module which is provided in the first end portion of the main body unit, and has a light emitting element; a holding unit which is provided inside the hole of the main body unit, has insulation properties, and an end portion on the second end portion side protrudes compared to a peripheral edge of the hole; and a power feeding terminal of which one end is electrically connected to the light emitting module, has electrical conductivity, and stretches inside the holding unit.

According to the lighting device for vehicle, it is possible to improve the insulation properties between a portion of the power feeding terminal which is exposed from the holding unit and the main body unit.

In the device, the end portion of the holding unit on the second end portion side may be provided with a concave portion.

By doing so, it is possible to make the shortest distance (creepage distance) which goes along the surface of the holding unit long between the power feeding terminal and the peripheral edge of the hole. For this reason, it is possible to further improve the insulation properties.

In addition, even when dust is generated when attaching the holding unit to the main body unit, it is hardly likely that the dust reaches inside the concave portion.

In the device, the power feeding terminal may be caused to protrude from a base of the concave portion.

By doing so, it is possible to make the creepage distance longer.

In the device, the main body unit may include a resin with high thermal conductivity.

By doing so, it is possible to make the lighting device for vehicle light.

Hereinafter, embodiments will be exemplified with reference to drawings. In each figure, the same constituent elements are given the same reference numerals, and detailed descriptions thereof will be appropriately omitted.

A lighting device for vehicle 1 according to an embodiment can be used, for example, in a front combination light, a rear combination light (stop lamp, tail lamp, turn signal, fog lamp, or the like), and the like, which are provided in a vehicle.

However, use of the lighting device for vehicle 1 is not limited to the exemplifications, and the lighting device for vehicle 1 can be widely used in a lighting device for vehicle which is provided in a vehicle, a railway vehicle, or the like.

FIG. 1 is a schematic perspective view for illustrating a lighting device for vehicle 1 according to the embodiment.

Figure 2:
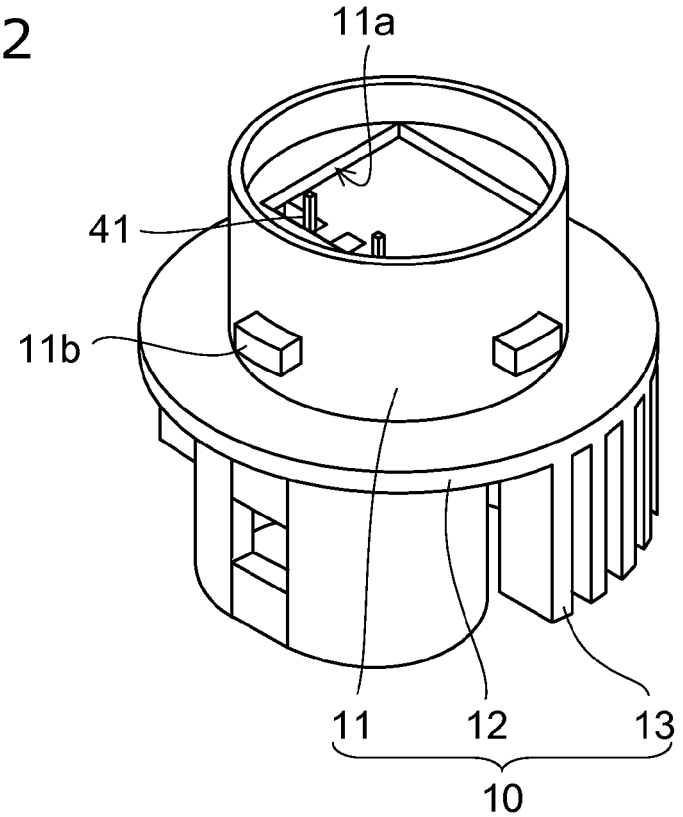
FIG. 2 is a schematic perspective view of a main body unit.

FIG. 2 is a schematic perspective view of a main body unit 10.

Figure 3:
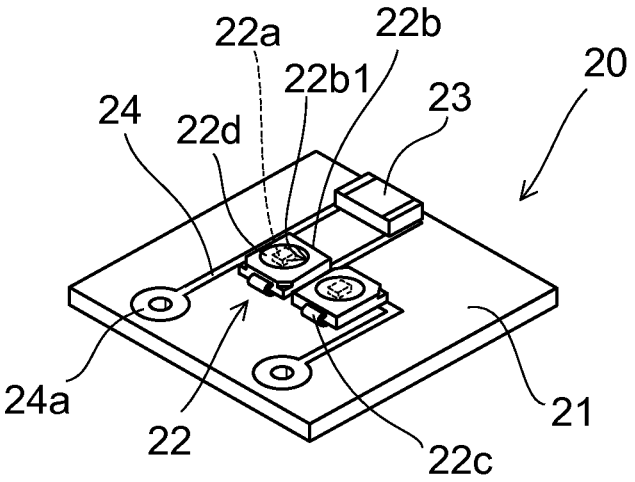
FIG. 3 is a schematic perspective view of a light emitting module.

FIG. 3 is a schematic perspective view of a light emitting module 20.

Figure 4:
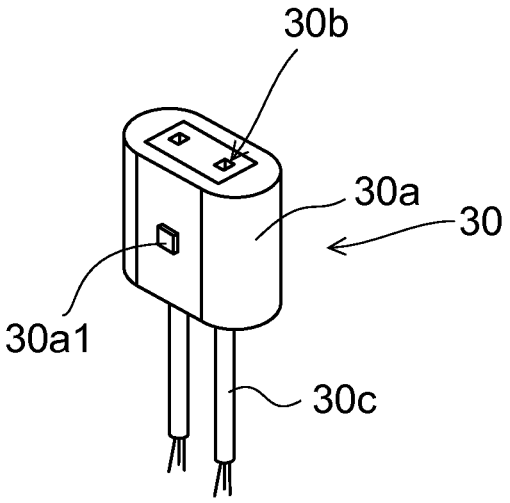
FIG. 4 is a schematic perspective view of a socket.

FIG. 4 is a schematic perspective view of a socket 30.

As illustrated in FIG. 1, in the lighting device for vehicle 1, the main body unit 10, the light emitting module 20, the socket 30, and a power feeding unit 40 are provided.

As illustrated in FIG. 1 or 2, the main body unit 10 is provided with an accommodation unit 11, a flange unit 12, and a fin 13.

The accommodation unit 11 has a cylindrical shape and protrudes from one face of the flange unit 12. A concave portion 11*a* is provided in the accommodation unit 11.

A substrate 21 is provided on a base of the concave portion 11*a*. A face of the substrate 21 on a side opposite to the side on which a light emitting unit 22 of the substrate 21 is provided comes into contact with the base of the concave portion 11*a*.

In addition, a plurality of power feeding terminals 41 protrudes from the base of the concave portion 11*a*. The plurality of power feeding terminals 41 do not come into contact with the base of the concave portion 11*a*.

A plurality of projecting portions 11*b* are provided on a side wall of the accommodation unit 11. The plurality of projecting portions 11*b* hold the lighting device for vehicle 1 to a lighting tool (not illustrated) in cooperation with an attaching member on the lighting tool side, when attaching the lighting device for vehicle 1 to the lighting tool, or the like, which is not illustrated.

It is possible to provide a sealing member which is formed of rubber, silicone, or the like, between the plurality of projecting portions 11*b* and the flange unit 12.

The flange unit 12 has a disc shape, the accommodation unit 11 is provided on one face thereof, and the fin 13 is provided on the other face.

A plurality of the fins 13 are provided by protruding from a face of the flange unit 12. The plurality of fins 13 have plate shapes, and function as heat radiating fins.

Here, the main body unit 10 has a function of accommodating the light emitting module 20, and a function of radiating heat which is generated in the light emitting module 20 to the outside of the lighting device for vehicle 1.

For this reason, it is preferable to form the accommodation unit 11, the flange unit 12, and the fin 13 using a material with high thermal conductivity in consideration of radiating heat to the outside.

It is preferable to make the lighting device for vehicle 1 lightweight.

For this reason, it is preferable to form the accommodation unit 11, the flange unit 12, and the fin 13 using a resin with high thermal conductivity.

The resin with high thermal conductivity is, for example, a resin which is obtained by mixing a fiber or particles formed of carbon with high thermal conductivity, aluminum oxide, or the like, into a resin such as polyethylene terephthalate (PET) and nylon.

In this case, it is possible to integrally mold the accommodation unit 11, the flange unit 12, and the fin 13.

In addition, it is also possible to separately form the accommodation unit 11, the flange unit 12, and the fin 13, and bond the units. When separately forming the accommodation unit 11, the flange unit 12, and the fin 13, it is possible to form the units using the same material, or using different materials.

As illustrated in FIG. 3, the substrate 21, the light emitting unit 22, a control element 23, and a wiring pattern 24 are provided in the light emitting module 20.

The substrate 21 is provided inside the accommodation unit 11 of the main body unit 10.

The substrate 21 has a plate shape, and the wiring pattern 24 is provided on a surface thereof.

The material or the structure of the substrate 21 is not particularly limited. For example, it is possible to form the substrate 21 using an inorganic material (ceramics) such as aluminum oxide, aluminum nitride, or the like, or an organic material, or the like, such as paper phenol or glass epoxy. In addition, the substrate 21 can be formed of a material which is obtained by covering the surface of a metal plate using an insulating material. When the surface of the metal plate is covered with an insulating material, the insulating material may be formed of an organic material, or an inorganic material.

When the heat amount of the light emitting unit 22 is large, it is preferable to form the substrate 21 using a material with high thermal conductivity in consideration of heat radiation. As the material with high thermal conductivity, for example, it is possible to exemplify ceramics such as aluminum oxide or aluminum nitride, a resin with high thermal conductivity, a material which is obtained by covering the surface of a metal plate with an insulating material, or the like.

The substrate 21 may be a single layer substrate, or a multilayer substrate.

The plurality of light emitting units 22 are mounted on the wiring pattern 24 which is provided on the surface of the substrate 21.

A light emitting element 22*a*, an envelope 22*b*, lead 22*c*, and a sealing unit 22*d* are provided in the light emitting unit 22.

The light emitting element 22*a* is provided inside a concave portion 22*b*1 which is provided in the envelope 22*b*.

The light emitting element 22*a* is electrically connected to the lead 22*c* which is exposed to the inside of the concave portion 22*b*1.

The light emitting element 22*a* can be made as, for example, a light emitting diode, an organic light emitting diode, a laser diode, or the like.

A top face of the light emitting element 22*a* which is an emission face of light faces the front face side of the lighting device for vehicle 1, and mainly emits light toward the front face side of the lighting device for vehicle 1.

The envelope 22*b* can be formed of, for example, a resin such as polybutylene terephthalate (PBT) or polycarbonate (PC), ceramics, or the like.

When a material of the envelope 22*b* is set to be a resin, it is possible to improve reflectance with respect to light which is emitted from the light emitting element 22*a* by mixing particles such as titanium oxide into the material.

However, it is not limited to particles of titanium oxide, and particles formed of a material having high reflectance with respect to light emitted from the light emitting element 22*a* may be mixed into the material.

In addition, it is possible to form the envelope 22*b* using a white resin, for example.

A side wall face of the concave portion 22*b*1 of the envelope 22*b* is a slope. Part of the light which is emitted from the light emitting element 22*a* is reflected on the side wall face of the envelope 22*b*, and is emitted toward the front face side of the lighting device for vehicle 1.

In addition, part of the light which is emitted toward the front face side of the lighting device for vehicle 1 from the light emitting element 22*a*, and is totally reflected on a top face (interface between sealing unit 22*d* and outside air) of the sealing unit 22*d* is reflected on the side wall face of the concave portion 22*b*1 of the envelope 22*b*, and is emitted toward the front face side of the lighting device for vehicle 1 again.

That is, the envelope 22*b* can also function as a reflector. The shape of the envelope 22*b* is not limited to the exemplification, and can be appropriately changed.

One end portion side of the lead 22*c* is exposed to the inside of the concave portion 22*b*1 of the envelope 22*b*.

The other end of the lead 22*c* is bent toward a face (base) on a side opposite to the side to which the concave portion 22*b*1 of the envelope 22*b* is open. The lead 22*c* can be a J bent-type lead.

A portion of the lead 22*c* which is exposed to the inside of the concave portion 22*b*1 is electrically connected to the light emitting element 22*a*.

A portion of the lead 22*c* which is bent toward the base of the envelope 22*b* is electrically connected to the wiring pattern 24.

For this reason, the light emitting element 22*a* is electrically connected to the wiring pattern 24 through the lead 22*c*.

The sealing unit 22*d* is provided in the concave portion 22*b*1 of the envelope 22*b*. The sealing unit 22*d* is provided so as to cover the inside of the concave portion 22*b*1. That is, the sealing unit 22*d* is provided inside the concave portion 22*b*1, and covers the light emitting element 22*a*, and one end portion side of the lead 22*c*.

The sealing unit 22*d* is formed of a material with light transmittance. It is possible to form the sealing unit 22*d* using, for example, a silicone resin, or the like.

It is possible to form the sealing unit 22*d* by filling the concave portion 22*b*1 of the envelope 22*b* with a resin, for example. Filling of a resin can be performed using a quantitative liquid discharge device such as a dispenser, for example.

When the concave portion 22*b*1 of the envelope 22*b* is filled with a resin, it is possible to suppress mechanical contact from the outside with respect to the light emitting element 22*a*. In addition, it is possible to suppress attachment of gas, moisture, or the like, to the light emitting element 22*a*, or the like. For this reason, it is possible to improve the reliability of the lighting device for vehicle 1.

It is possible to make the sealing unit 22*d* contain a fluorescence substance. The fluorescence substance may be, for example, a YAG-type fluorescence substance (yttrium-aluminum-garnet fluorescence substance).

For example, when the light emitting element 22*a* is a blue light emitting diode and the fluorescence substance is the YAG-type fluorescence substance, the YAG-type fluorescence substance is excited due to blue light which is emitted from the light emitting element 22*a*, and yellow fluorescence is radiated from the YAG-type fluorescence substance. In addition, white light is emitted from the lighting device for vehicle 1 when the blue light and yellow light are mixed together. The type of the fluorescence substance or a type of the light emitting element 22*a* is not limited to the exemplification, and it is possible to appropriately change the type so as to obtain a desired color of the emitted light according to a use, or the like, of the lighting device for vehicle 1.

The light emitting unit 22 which is illustrated in FIG. 3 is a Plastic Leaded Chip Carrier (PLCC) type; however, the form of the light emitting unit 22 is not limited to this.

For example, the light emitting unit 22 may include the light emitting element 22*a* which is mounted on the wiring pattern, an annular reflector which surrounds the light emitting element 22*a*, and the sealing unit 22*d* which is provided inside the annular reflector.

That is, the light emitting element 22*a* may be mounted on the wiring pattern 24 using Chip on Board (COB).

The number or arrangement of the light emitting unit 22 is not limited to the exemplification, and can be appropriately changed according to the use, or the like, of the lighting device for vehicle 1.

The control element 23 is mounted on the wiring pattern 24.

The control element 23 controls a current which flows in the light emitting element 22*a*. That is, the control element 23 controls the light emission of the light emitting element 22*a*.

The number or the size of the control element 23 is not limited to the exemplification, and can be appropriately changed according to the number, the specification, or the like, of the light emitting element 22*a*.

The wiring pattern 24 is provided at least on one side of the surface of the substrate 21.

It is preferable to provide the wiring pattern 24 on the surface on one side of the substrate 21 in order to reduce a manufacturing cost, though it is also possible to provide the wiring pattern on both surfaces of the substrate 21.

An input terminal 24*a* is provided in the wiring pattern 24.

The input terminal 24*a* is provided in a plural manner. The power feeding terminal 41 is electrically connected to the input terminal 24*a*. For this reason, the light emitting element 22*a* is electrically connected to the power feeding terminal 41 through the wiring pattern 24.

In addition, it is possible to appropriately provide a circuit component, or the like (not illustrated,) as necessary. It is possible to mount the circuit component (not illustrated) on the wiring pattern 24, for example.

As illustrated in FIG. 4, a main body unit 30*a*, a female type terminal 30*b*, and wiring 30*c* are provided in the socket 30.

The main body unit 30*a* is formed of an insulating material such as a resin. A projecting portion 30*a*1 is provided on a side wall of the main body unit 30*a*. The socket 30 is held by the main body unit 10 when the projecting portion 30*a*1 is inserted into the concave portion which is provided in the main body unit 10.

The female type terminal 30*b* stretches inside the main body unit 30*a*.

One end portion of the female type terminal 30*b* is exposed to one end face of the main body unit 30*a*. The power feeding terminal 41 is fitted to an end portion of the female type terminal 30*b* which is exposed to one end face of the main body unit 30*a*.

The wiring 30*c* is electrically connected to the other end of the female type terminal 30*b*.

A power supply, or the like (not illustrated), is electrically connected to the wiring 30*c*.

For this reason, when the socket 30 is fitted to the power feeding terminal 41, the power supply (not illustrated), or the like, and the light emitting element 22*a* are electrically connected.

The socket 30 can be bonded to elements on the main body unit 10 side using, for example, an adhesive, or the like.

Subsequently, the power feeding unit 40 will be described.

Figure 5:
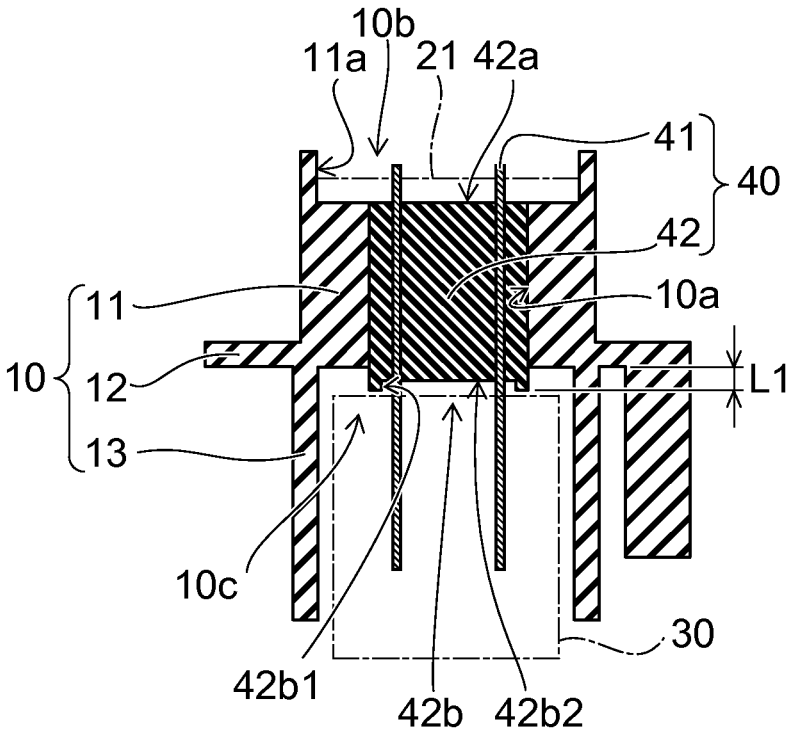
FIG. 5 is a schematic sectional view which illustrates a power feeding unit.

FIG. 5 is a schematic sectional view for illustrating the power feeding unit 40.

In addition, FIG. 5 is a diagram which illustrates a section including a line A-A in FIG. 1.

As illustrated in FIG. 5, the power feeding terminal 41 and the holding unit 42 are provided in the power feeding unit 40.

A plurality of the power feeding terminals 41 is provided.

The power feeding terminal 41 has a linear shape, and is formed of a conductive material such as metal.

The plurality of power feeding terminals 41 stretches by penetrating the holding unit 42.

An end portion of the power feeding terminal 41 on the input terminal 24*a* side protrudes from an end portion 42*a* of the holding unit 42 on the input terminal 24*a* side. The power feeding terminal 41 which protrudes from the end portion 42*a* of the holding unit 42 protrudes from a base of the concave portion 11*a*, and is electrically connected to the input terminal 24*a*.

An end portion of the power feeding terminal 41 on the socket 30 side protrudes from an end portion 42*b* of the holding unit 42 on the socket 30 side. The power feeding terminal 41 which protrudes from the end portion 42*b* of the holding unit 42 is fitted to the female type terminal 30*b*.

Two power feeding terminals 41 are exemplified; however, the number, the shape, or the like, of the power feeding terminal 41 is not limited to the exemplification, and can be appropriately changed.

As described above, it is preferable to form the main body unit 10 using a resin with high thermal conductivity.

As the resin with high thermal conductivity, there is a resin with high thermal conductivity which is obtained by mixing a fiber or particles formed of carbon into a resin. For this reason, there is a resin with high thermal conductivity which has electrical conductivity.

When a resin with high thermal conductivity having electrical conductivity is used, a short circuit occurs when the main body unit 10 and the power feeding terminal 41 come into contact with each other.

For this reason, the holding unit 42 which is formed of an insulating material is provided between the main body unit 10 and the power feeding terminal 41.

The holding unit 42 is provided inside a hole 10*a* which is provided in the main body unit 10.

The hole 10*a* penetrates between an end portion 10*b* of the main body unit 10 (corresponding to an example of first end portion) on a side on which the light emitting module 20 is provided and an end portion 10*c* (corresponding to an example of second end portion) on a side on which the socket 30 is provided.

The operating environment of the lighting device for vehicle 1 is −40° C. to 85° C. For this reason, it is preferable that the linear expansion coefficient of the resin with high thermal conductivity which is a material of the main body unit 10, and the linear expansion coefficient of a resin which is a material of the holding unit 42 are set so as to be as close to each other as possible. By doing so, it is possible to reduce thermal stress which occurs between the main body unit 10 and the holding unit 42, even when the lighting device for vehicle 1 is used in circumstances in which the change in temperature is significant.

In this case, it is possible to form the holding unit 42 using a resin which belongs to the resin with high thermal conductivity.

For example, when the resin with high thermal conductivity is obtained by mixing a fiber or particles formed of carbon into a PET, it is possible to form the holding unit 42 using PET.

Here, an end portion of the power feeding terminal 41 on the socket 30 side is exposed from the holding unit 42 so as to be fitted to the female type terminal 30*b* of the socket 30.

In this case, when a creepage distance between the power feeding terminal 41 and the main body unit 10 becomes short, a short circuit between the power feeding terminal 41 and the main body unit 10 easily occurs.

For this reason, the end portion 42*b* of the holding unit 42 on the socket 30 side protrudes from a peripheral edge of the hole 10*a* of the main body unit 10.

When the end portion 42*b* of the holding unit 42 protrudes from the peripheral edge of the hole 10*a* of the main body unit 10, it is possible to make the shortest distance (creepage distance) which goes along the surface of the holding unit 42 long between the power feeding terminal 41 and the peripheral edge of the hole 10*a*.

According to the acquired knowledge of the inventor, it is possible to secure enough insulation for the lighting device for vehicle 1 when setting a protruding dimension L1 of the end portion 42*b* to be equal to or greater than 0.5 mm.

In addition, when setting the shortest distance (creepage distance) along the surface of the holding unit 42 to be equal to or greater than 1 mm between the power feeding terminal 41 and the peripheral edge of the hole 10*a*, it is possible to secure enough insulation for the lighting device for vehicle 1.

A concave portion 42*b*1 can be provided in the end portion 42*b* of the holding unit 42 on the socket 30 side.

In addition, it is possible to provide the power feeding terminal 41 inside the concave portion 42*b*1. In this case, it is possible to make the power feeding terminal 41 protrude from a base 42*b*2 of the concave portion 42*b*1.

By doing so, it is possible to make the shortest distance longer (creepage distance) along the surface of the holding unit 42 between the power feeding terminal 41 and the peripheral edge of the hole 10*a*.

Here, when attaching the holding unit 42 to the main body unit 10, the holding unit 42 is inserted from an end portion of the hole 10*a* on the light emitting module 20 side.

Since the resin with high thermal conductivity as a material of the main body unit 10 is fragile, when the holding unit 42 is inserted into the hole 10*a*, there is a concern that dust with electrical conductivity may be generated due to chipped resin with high thermal conductivity.

When the dust with electrical conductivity is attached between the power feeding terminal 41 and the peripheral edge of the hole 10*a*, a short circuit can easily occur between the power feeding terminal 41 and the main body unit 10 through the dust with electrical conductivity.

When the concave portion 42*b*1 is provided at the end portion 42*b* of the holding unit 42, it is hardly likely that the generated dust reaches the inside of the concave portion 42*b*1 unless the dust leap over the edge of the concave portion 42*b*1.

For this reason, it is possible to prevent the dust with electrical conductivity from coming into the concave portion 42*b*1.

It is possible to make a sectional dimension of the holding unit 42 (sectional dimension in direction orthogonal to direction in which power feeding terminal 41 stretches) gradually small toward the end portion 42*b* side.

For example, it is possible to make a sectional dimension of the end portion 42*b* shorter than that of the end portion 42*a*.

That is, it is preferable to make the holding unit 42 in a tapered shape.

According to the acquired knowledge of the inventor, it is preferable to set the angle of tapering the holding unit 42 to 1° or more.

When the angle of tapering the holding unit 42 is set to 1° or more, it is possible to reduce the amount of dust which is generated when inserting the holding unit 42 into the hole 10*a*.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions. Moreover, above-mentioned embodiments can be combined mutually and can be carried out.

What is claimed is:

1. A lighting device for a vehicle, comprising:

a main body unit which has a hole penetrating between a first end portion and a second end portion in a penetration direction, and in which at least the vicinity of the hole has electrical conductivity, wherein the main body unit includes:

a flange portion extending outwardly in a direction perpendicular to the penetration direction, and at least one fin extending in the penetration direction from the flange portion;

a light emitting module which is provided in the first end portion of the main body unit, and has a light emitting element;

a holding unit which has a tapered shape and is provided inside the hole of the main body unit, the holding unit being in close contact with the main body unit, the holding unit having insulation properties, and an end portion disposed on a side of the main body unit including the second end portion, the end portion having a protruded portion which protrudes compared to a peripheral edge of the hole; and a plurality of power feeding terminals each of which having one end electrically connected to the light emitting module, having electrical conductivity, stretching inside the holding unit, and being in close contact with the holding unit, wherein the end portion of the holding unit on the second end portion side being provided with a concave portion, a part of each of the plurality of power feeding terminals protruding from a base of one concave portion, the part of each of the plurality of power feeding terminals being not insulated.

2. The device according to claim 1, wherein the main body unit includes a resin with high thermal conductivity.

3. The device according to claim 2, wherein the resin with high thermal conductivity includes at least any one of a fiber which is formed of carbon and particles which are formed of carbon.

4. The device according to claim 2, wherein the resin with high thermal conductivity includes polyethylene terephthalate (PET).

5. The device according to claim 2, wherein the holding unit includes the same resin as that in the resin with high thermal conductivity.

6. The device according to claim 1, wherein the holding unit includes polyethylene terephthalate (PET).

7. The device according to claim 1, wherein the end portion of the holding unit on the second end portion side protrudes 0.5 mm or more compared to the peripheral edge of the hole.

8. The device according to claim 1, wherein, in the protruded portion of the holding unit, the shortest distance along a surface between the power feeding terminal and the peripheral edge of the hole is equal to or greater than 1 mm.

9. The device according to claim 1, wherein a sectional dimension of the holding unit in a direction orthogonal to a direction in which the power feeding terminals stretch is gradually reduced toward the second end portion side.

10. The device according to claim 1, wherein a sectional dimension of the holding unit on the second end portion side in a direction orthogonal to a direction in which the power feeding terminals stretch is smaller than the sectional dimension of the holding unit on a first end portion side of the main body unit.

11. The device according to claim 1, wherein an angle of tapering is equal to or greater than 1°.

12. The device according to claim 1, wherein the light emitting module includes a substrate which has a wiring pattern on the surface, wherein the light emitting element is electrically connected to the wiring pattern, and wherein the substrate is formed of any one of ceramics, a resin with high thermal conductivity, and a material which is obtained by covering the surface of a metal plate with an insulating material.

13. The device according to claim 12, wherein the light emitting module further includes a lead of which one end portion side is electrically connected to the light emitting element, and the other end portion side is electrically connected to the wiring pattern.

14. The device according to claim 13, wherein the lead is J bent-type lead.

15. The device according to claim 13, wherein the light emitting module further includes an envelope, wherein the one end portion side of the lead is exposed to an inside of the envelope, and wherein the other end portion side of the lead is exposed to an outside of the envelope.

16. The device according to claim 15, wherein the envelope includes a concave portion, and wherein the one end portion side of the lead is exposed to an inside of the concave portion.

17. The device according to claim 16, wherein a side wall face of the concave portion is a slope.

* * * * *